US006202872B1

(12) United States Patent
Smeyak et al.

(10) Patent No.: US 6,202,872 B1
(45) Date of Patent: Mar. 20, 2001

(54) COMPOSITE CLOSURE WITH ENHANCED SEALING

(75) Inventors: Lawrence M. Smeyak, Lafayette; Michael R. Zurawski, Crawfordsville; Mark R. Russell, Crawfordsville; Mark A. Powell, Crawfordsville; Budan Yao, Danville, all of IN (US)

(73) Assignee: Alcoa Closure Systems International, Crawfordsville, IN (US)

( * ) Notice: Subject to any disclaimer, the term of this patent is extended or adjusted under 35 U.S.C. 154(b) by 0 days.

(21) Appl. No.: 09/410,390

(22) Filed: Oct. 1, 1999

(51) Int. Cl.[7] ..... B65D 53/04

(52) U.S. Cl. ..... 215/343; 215/349; 53/421; 53/490

(58) Field of Search ..... 215/341, 343, 215/344, 345, 349, 350, 351, 252; 53/421, 490

(56) References Cited

U.S. PATENT DOCUMENTS

| | | | | |
|---|---|---|---|---|
| 4,114,775 | * | 9/1978 | Shinozaki | 215/343 X |
| 4,378,893 | * | 4/1983 | Wilde et al. | 215/343 X |
| 4,415,096 | * | 11/1983 | Ohmi | 215/343 |
| 4,497,765 | | 2/1985 | Wilde et al. . | |
| 4,709,825 | * | 12/1987 | Mumford | 215/343 X |
| 4,938,370 | | 7/1990 | McBride . | |
| 4,978,017 | | 12/1990 | McBride . | |
| 5,064,084 | * | 11/1991 | McBride et al. | 215/343 X |
| 5,297,688 | * | 3/1994 | Beck et al. | 215/343 X |
| 5,673,809 | * | 10/1997 | Ohmi et al. | 215/343 X |
| 5,762,219 | * | 6/1998 | Parrinello | 215/341 X |
| 5,769,255 | * | 6/1998 | Ohmi et al. | 215/345 |
| 5,806,707 | * | 9/1998 | Boehm et al. | 215/345 X |
| 5,924,586 | * | 7/1999 | Gregory et al. | 215/350 |
| 6,044,995 | * | 4/2000 | Dai | 215/252 X |

FOREIGN PATENT DOCUMENTS

| | | | | |
|---|---|---|---|---|
| 597052 | * | 3/1978 | (CH) | 215/350 |

* cited by examiner

*Primary Examiner*—Nathan J. Newhouse
(74) *Attorney, Agent, or Firm*—Rockey Milnamow & Katz Ltd.

(57) ABSTRACT

A composite closure for a container having carbonated contents includes an outer closure cap having a top wall portion, and an annular depending skirt portion. A disc-shaped sealing liner is positioned within the closure cap adjacent the inside surface of the top wall portion. The liner includes an inwardly facing sealing portion at the periphery thereof, and further includes an annular seal bead which projects downwardly from the liner in a direction away from the top wall portion. The closure is configured for enhanced sealing with an associated container, with the top wall portion of the outer closure cap preferably including a relatively thick, peripheral reinforcing region which overlies the annular seal bead of the liner for further enhancing sealing.

8 Claims, 2 Drawing Sheets

COMPOSITE CLOSURE WITH ENHANCED SEALING

TECHNICAL FIELD

The present invention relates generally to a molded plastic closure, and more particularly to a composite closure including a molded plastic outer cap, and an inner molded sealing liner, wherein the cap and liner are configured for enhanced sealing, particularly when the closure is applied to a container having carbonated or otherwise pressurized contents. The closure liner includes an annular seal bead feature which cooperates with a peripherally reinforced region of the top wall of the closure cap to enhance sealing performance.

BACKGROUND OF THE INVENTION

Molded plastic closures have found increasingly widespread acceptance in the marketplace for all manner of applications, including widespread use on containers having carbonated or otherwise pressurized contents. This type of application can be somewhat problematic, in that gas pressure within the container can tend to deform a plastic closure during normal storage, shipment, and retail sale. This type of deformation of the closure, which is in the nature of a cold flow phenomenon as the gas pressure acts against the inside surface of the closure, can result in outward bowing or "doming" of the top wall portion of a closure. This deformation can inhibit the sealing integrity of the closure, since the deformation can result in diminished sealing engagement between the inside surface of the closure top wall and the upper surface of the associated container.

U.S. Pat. No. 4,497,765, hereby incorporated by reference, discloses a so-called composite closure, and method of formation, which has proven to be very highly effective for packaging of carbonated beverages and the like. This type of closure is particularly configured to form a "top/side seal" with an associated container, by the provision of a sealing liner positioned adjacent the inside surface of the top wall of an outer closure cap of the composite closure. The sealing liner includes an annular sealing portion at the periphery thereof which presents a generally inwardly facing sealing surface. The liner is thus configured to make sealing engagement with both upwardly facing and outwardly facing surfaces of the associated container, for the formation of the desired top/side seal. Experience has shown that in the event that this type of closure is subjected to doming or like deformation, the sealing integrity of the closure is maintained by the inwardly facing sealing surface of the closure liner, even if deformation of the closure results in diminished sealing engagement between the liner and the upwardly facing surface of the container.

While the above-described composite closure construction has proven to be very commercially successful, it is desirable to provide these types of closures with the best possible sealing performance that can be achieved at acceptable cost. Experience has shown that under some storage and handling conditions of containers, closures can be subjected to top-loading which may disrupt the sealing integrity of closures forming top/side seals, as described above. The present invention is directed to a composite closure configured to provide enhanced sealing under the various types of conditions which are typically encountered during shipment and storage of containers having carbonated contents on which the closures are used.

SUMMARY OF THE INVENTION

A composite closure embodying the principles of the present invention includes an outer plastic closure cap, and an inner sealing liner positioned adjacent an inside surface of a top wall portion of the cap. The sealing liner is configured to include a generally inwardly facing sealing portion at the periphery thereof which functions to provide principal or primary sealing engagement with an associated container, by sealing engagement with a generally outwardly facing surface of the container. The sealing liner further includes an annular seal bead positioned for cooperation with the peripheral sealing portion of the liner. The annular seal bead projects downwardly away from the top wall portion of the closure cap, and presents a generally downwardly facing sealing surface for sealing engagement with an upwardly facing surface of the associated container. While the seal bead is generally provided in the present closure as a secondary form of sealing, under certain circumstances, the seal bead can provide as much, or more, sealing cooperation with the associated container than the inwardly facing sealing portion of the liner. In the preferred form, the top wall portion of the outer closure cap includes a relatively thick reinforcing region generally at the periphery thereof which overlies the seal bead of the sealing liner. The reinforcing portion acts together with the sealing liner to maintain the closure in sealing engagement with an associated container, thus providing enhanced sealing properties for the present closure construction.

In accordance with the illustrated embodiment, an outer closure cap of the present composite closure assembly includes a top wall portion, and an annular skirt portion depending from the top wall portion. The skirt portion includes an internal thread formation configured for threaded, cooperating engagement with a like thread formation on an associated container. The skirt portion includes an inwardly extending annular shoulder positioned at the juncture of the top wall portion and the skirt portion. In the illustrated embodiment, the annular shoulder defines an annular recess positioned adjacent the top wall portion.

The present composite closure further includes a sealing liner positioned within the closure cap adjacent the inside surface of the top wall portion. The liner includes a generally inwardly facing sealing portion of the periphery thereof adjacent the annular shoulder and the skirt portion. In the illustrated embodiment, the sealing portion of the liner extends into the annular recess defined by the annular shoulder.

The sealing liner further includes an annular seal bead, as described above, projecting downwardly away from the top wall portion, adjacent the juncture of the top wall portion and skirt portion. The seal bead presents a generally downwardly facing sealing surface for sealing engagement with a generally upwardly facing surface of the associated container. By this configuration, the sealing surface of the seal bead provides sealing in cooperation with the inwardly facing sealing portion of the closure liner.

The annular seal bead has a cross-section configuration that tapers inwardly in a direction away from the top wall portion. In the preferred embodiment, the annular seal bead has a generally convex cross-sectional configuration, and is generally hemispherical in cross-section.

Use of the present closure construction provides a method for sealing a container having pressurized contents during top-loading of the container. The composite closure in accordance with the present invention is applied to a container so that the sealing portion of the liner sealingly engages a generally outwardly facing surface of the container. Attendant to normal storage and shipment, the top wall portion of the closure cap is outwardly deformed under the influence of pressure within the container. Despite such deformation, the sealing portion of the liner is maintained in sealing engagement with the container by virtue of the top/side sealing characteristics of the closure.

During typical handling and storage, the closure is subjected to top-loading in opposition to the outward deformation of the top wall portion. This action urges the annular seal bead of the sealing liner into sealing engagement with a generally upwardly facing surface of the container before the sealing portion of the liner is moved out of sealing engagement with the outwardly facing surface of the container. The timing of the engagement of the annular seal bead with the container top sealing surface during top-loading is such that the annular seal bead will engage the container before significant perturbation of the closure cap, through the application of top-load, results in significant loss of internal container pressure through the primary sealing mechanism provided at the inwardly facing, peripheral sealing portion of the liner. In practice, it is contemplated that the annular seal ring of the sealing liner is configured to always remain in contact with the top sealing surface of the container, even during doming or like deformation of the top wall portion of the closure.

Other features and advantages of the present invention will become readily apparent from the following detailed description, the accompanying drawings, and the appended claims.

DETAILED DESCRIPTION

Figure 1:
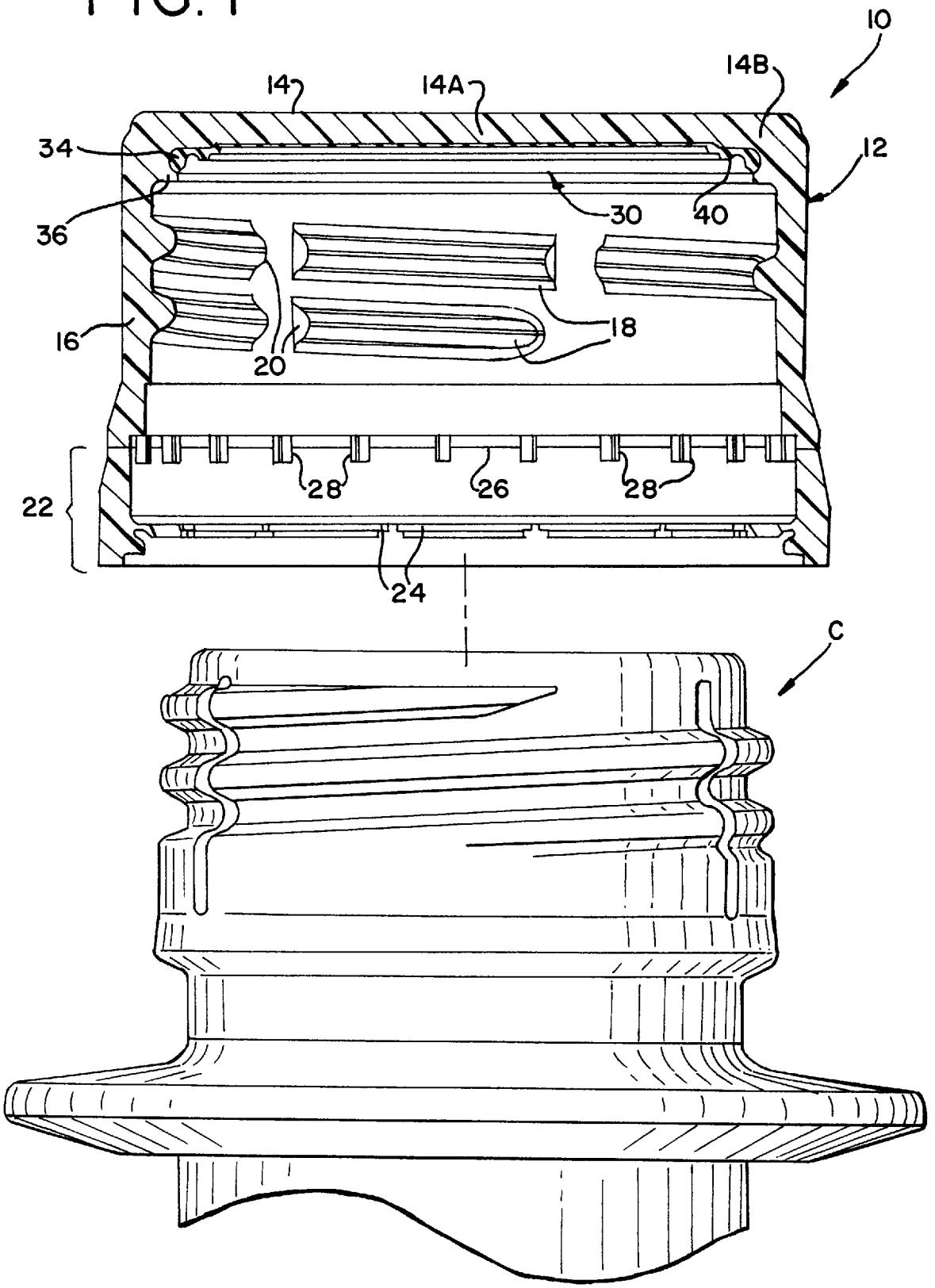
FIG. 1 is a cross-sectional view of a composite closure embodying the principles of the present invention and an associated container.
Figure 2:
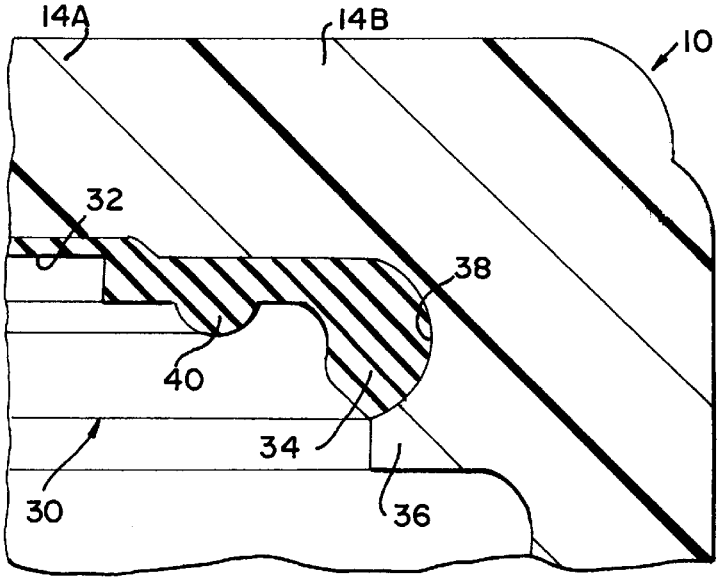
FIG. 2 is a relatively enlarged, fragmentary view illustrating the sealing features of the present composite closure.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference to the drawings, therein is illustrated a composite closure 10 embodying the principles of the present invention. Closure 10 is generally configured in accordance with the teachings of U.S. Pat. No. 4,497,765, hereby incorporated by reference, in that it includes an outer molded plastic closure cap 12, and an inner sealing liner, as will be further described, positioned within the closure cap. In the preferred form, the sealing liner is formed in situ within the closure cap 12 by compression molding. While formation of closure cap 12 by compression molding is preferred, it will be understood that the outer closure cap may be otherwise formed, such as by injection molding. This type of closure has proven to be particularly effective for use on containers having carbonated beverages or otherwise pressurized contents, in that the sealing liner of the closure provides the desired sealing conformance and cooperation with the associated container, while the outer closure cap (typically formed from polypropylene) provides the necessary strength for the closure to meet the performance demands associated with this type of closure application.

The closure cap 12 includes a generally circular top wall portion 14 which, as will be further described, includes a central region 14A, and a relatively thick peripheral reinforcing region 14B. The closure cap further includes an annular skirt portion 16 depending from the top wall portion 14. The skirt portion 16 includes an internal thread formation 18 for mating, threaded engagement with a like thread formation on an associated container C. One or more vent passages 20 can be provided in the closure cap traversing the thread formation 18 to facilitate release of gas pressure from within an associated container during removal of the closure therefrom.

A tamper-evident pilfer band 22 is at least partially detachably connected to, and depends from, the skirt portion 16. In the illustrated embodiment, the pilfer band 22 is configured in accordance with the teachings of U.S. Pat. No. 4,938,370, hereby incorporated by reference. Accordingly, the pilfer band 22 includes a plurality of inwardly extending, relatively flexible projections 24 which are configured for cooperative interaction with an associated container. The pilfer band is distinguished from the closure skirt by a circumferentially extending score line 26, with a plurality of circumferentially spaced frangible bridges 28 extending between the inside surfaces of the pilfer band and the skirt portion for providing a frangible connection between the pilfer band and the skirt.

In accordance with the present invention, composite closure 10 includes a generally disc-shaped sealing liner 30 positioned adjacent the inside surface of top wall portion 14. Sealing liner 30 is preferably formed in situ, by compression molding molten plastic material within the closure cap 12. The sealing liner 30 includes a central portion 32, and an sealing portion 34 at the periphery thereof which presents a generally inwardly facing sealing surface for sealing engagement with a generally outwardly facing surface of an associated container. At the same time, the sealing liner is configured to engage a generally upwardly facing surface of the associated container, and thus is configured to form a so-called top/side seal. Experience has shown that gas pressure within a container to which the closure is applied can result in outward deformation of the top wall portion 14, sometimes referred to as "doming", which deformation can act to diminish the sealing engagement between the downwardly facing portion of the sealing liner 30, and the upwardly facing portion of the associated container. By the formation of a top/side seal, the sealing integrity of the closure is maintained by virtue of the sealing engagement of the inwardly facing sealing surface of sealing portion 34 with the generally outwardly facing sealing surface of the container C.

In situ formation of sealing liner 30 within closure cap 12 is facilitated by the provision of an annular shoulder 36 which extends generally inwardly of the skirt portion 16 at the juncture of top wall portion 14 and skirt portion 16. Annular shoulder 36 provides a sealing surface against which liner-forming tooling is urged during compression molding of liner 30. In accordance with the illustrated embodiment, the annular shoulder 36 defines an annular recess 38 positioned adjacent the top wall portion 14, with the sealing portion 34 of liner 30 extending into the annular recess. This preferred configuration permits the sealing portion of the liner 30 to readily conform to an associated container, while accommodating the normal manufacturing tolerances which are exhibited by both the closure and the container. As shown, the central region of portion 32 of the liner 30 is preferably relatively thin to minimize use of the relatively costly liner forming material, typically ethylene vinyl acetate (EVA). This region does not provide any sealing coaction with the container C.

In accordance with the present invention, the sealing liner 30 includes an annular seal bead 40 which projects downwardly away from top wall portion 14 of closure cap 12. The seal bead 40 is positioned generally adjacent the juncture of top wall portion 14 and skirt portion 16, with the seal bead presenting a generally downwardly facing sealing surface for sealing cooperation with the inwardly facing sealing surface of sealing portion 34.

In particular, the annular seal bead is configured to be positioned above the upwardly facing, substantially horizontal surface of the associated container C such that the annular seal bead will engage the top of the container during initial application of the closure thereto. Moreover, the seal bead 40 is configured to provide sealing engagement between the closure and the container during top-loading of the resultant package, which loading is a common occurrence in warehouse palletizing. It is contemplated that the engagement of the annular seal bead 40 during top-loading will provide an additional or supplemental sealing mechanism for the closure, apart from that provided by sealing portion 34, thereby enhancing package shelf life by preventing pre-release of internal container pressure due to perturbation of the closure seal provided at sealing portion 34.

It is believed that the manner in which the seal bead 40 engages the associated container during top-loading is important to maintaining the sealing integrity of the closure 10. As a result of outward deformation of top wall portion 14, under the influence of internal gas pressure, the seal bead 40 may not be in full sealing engagement with the associated container, with the sealing of the container effected by the inwardly facing surface presented by sealing portion 34 of the liner 30. If the package is subjected to top-loading, it is believed to be important that the annular seal bead 40 be moved into sealing engagement with the associated container before the perturbation of the closure cap, due to application of top-loading, results in significant loss of internal container pressure through the primary sealing mechanism, that is, at sealing portion 34. While the exact dimensions of the annular seal bead 40 can be varied while keeping with the principles disclosed herein, it is contemplated that the annular seal ring be sufficiently sized so as to preclude the annular seal bead from moving out of engagement with the associated container, even if the top wall portion of the closure is subjected to outward deformation or doming. In a current embodiment, wherein composite closure 10 is configured for application to a standardized 28 millimeter container finish, the annular seal bead has a radial dimension on the order of approximately 0.453 inches, and a vertical or axial dimension of approximately 0.009 inches, relative to the adjacent region of sealing liner 30.

Figure 3:
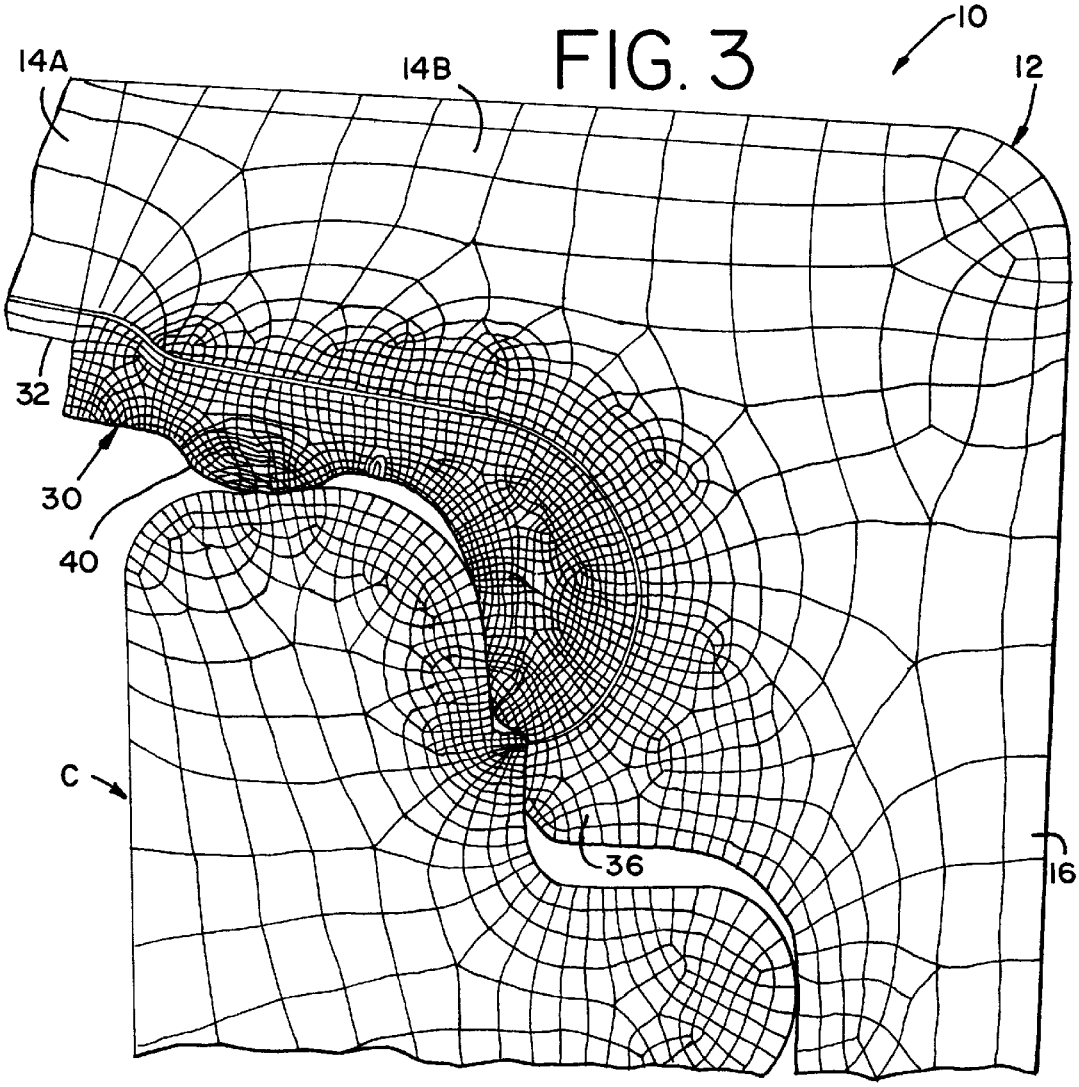
FIG. 3 is an illustration generated by finite element analysis showing regions of relatively high deformation and corresponding strain attendant to application of the present composite closure to an associated container.

While the exact cross-sectional configuration of the annular seal bead can be varied while keeping with the principles disclosed herein, it is presently preferred that the seal bead taper inwardly in a direction away from the top wall, and have a generally convex cross-sectional configuration, that is, the seal bead is generally hemispherical or curvilinear in cross-section. Finite element analysis, as exemplified by the illustration of FIG. 3, has shown that this preferred cross-sectional configuration of the annular seal bead desirably functions such that regions of maximum strain within the seal bead of sealing liner 30 are positioned away from the surface of the seal bead.

In accordance with the illustrated embodiment, composite closure 10 is configured such that the region of the annular seal bead 40 is reinforced for further enhancing sealing performance. In particular, as noted above, top wall portion 14 of closure cap 12 includes a peripheral reinforcing region 14B which has a thickness greater than the central region 14A of the top wall portion. The reinforcing region 14B of the top wall portion is configured so as to overlie the annular seal bead 40 of the sealing liner. The reinforcing region overlies the sealing bead 40 of the liner in that the seal bead is at least partially overlapped by the peripheral reinforcing region 14B of the top wall portion. In the illustrated embodiment, the seal bead 40 is substantially completely overlapped by the relatively thick reinforcing region 14B, that is, the inside diameter of the reinforcing region 14B is less than the inside diameter of the annular seal bead 40.

Axial thickening of the top wall portion in the reinforcing region 14B desirably acts to limit the outward deformation or doming of the closure top wall portion under the influence of internal container pressure. Limitation of such deformation desirably acts to maintain intimate contact between the annular seal bead 40 and the top of the associated container during storage and handling. It is believed that even if intimate, sealing contact between the annular seal bead 40 and the container surface is temporarily lost, limiting of top wall portion deformation desirably tends to improve the timing of engagement of the annular seal bead 40 during top loading before the potential loss of side sealing at the inwardly facing sealing surface of sealing portion 34 due to perturbation of the closure cap and liner.

It will be understood that the exact dimension of a closure embodying the present invention may vary widely while achieving the desired coaction with an associated container, and thus, the following dimensions are intended as illustrative. In a current embodiment, wherein the composite closure 10 is configured for use on a standardized 28 millimeter container finish, the following dimensional configurations of the closure have proven to provide the enhanced sealing performance which can be achieved by practice of the present invention. In this current embodiment, the central portion 32 of sealing liner 30 has a nominal thickness on the order of 0.005 inches, while the thickness of the liner at the annular seal bead 40 is about 0.21 inches, with the seal bead 40 having a radial dimension of 0.453 inches. With reference to the closure cap 12, the nominal thickness of the central region 14A of top wall portion 14 is about 0.055 inches, while the relatively thick reinforcing region 14B has a thickness on the order of 0.060 inches. The reinforcing region 14B overlies the annular seal bead 40 by configuring the inside diameter of the reinforcing region to be no greater than the outside diameter of the annular seal bead, with the inside diameter of the reinforcing region being less than the inside diameter of the annular seal bead 40 in the illustrated embodiment. In this current illustrated embodiment, the inside diameter of the reinforcing region 14B is about 0.437 inches, while the inside diameter of the annular seal bead 40 is about 0.443 inches.

As will be appreciated from the above discussion, use of the present composite closure 10 on a container having pressurized contents provides an improved method for effecting sealing of the container, particularly during top-loading of the container and closure as is typically encountered during normal storage and shipment of packages. A composite closure configured in accordance with the present invention is applied to a container so that the sealing portion 34 of the sealing liner 30 sealingly engages the generally outwardly facing surface of the associated container. Under the influence of gas pressure within the container, the top wall portion 14 of the outer closure cap 12 is subjected to outward deformation, with the top/side sealing configuration of the closure desirably acting to maintain the sealing portion 34 in sealing engagement with the container C.

During storage and shipment, the closure is subjected to top-loading in opposition to outward deformation of the top wall portion 14. This action tends to urge the annular seal bead 40 into sealing engagement with the generally upwardly facing surface of the container C. Significantly, this enhanced sealing engagement between the annular seal bead 40 and the container is effected before the sealing portion 34 of the liner is moved in a direction out of sealing engagement with the outwardly facing surface of the container. Thus, the present closure is configured such that annular seal bead 40 coacts with the sealing portion 34 so that the contents of container C are effectively sealed under the various conditions to which the package is subjected during normal handling. Notably, testing has shown that this enhanced sealing action is evidenced during the testing to which packages are typically subjected, including those tests which subject the top wall of the closure to top-loading.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A composite closure, comprising:

an outer closure cap having a top wall portion, and an annular skirt portion depending from said top wall portion, said skirt portion including an inwardly extending annular shoulder positioned at the juncture of said top wall portion and said skirt portion, and a sealing liner positioned within said closure cap adjacent the inside surface of said top wall portion, said liner including a generally inwardly facing sealing portion at the periphery thereof adjacent said annular shoulder of said skirt portion, said sealing liner further including an annular seal bead projecting downwardly away from said top wall portion adjacent the juncture of said top wall portion and said skirt portion, said seal bead presenting a generally downwardly facing sealing surface for sealing cooperation with said inwardly facing sealing portion of said liner, said top wall portion of said closure cap including a central region, and a peripheral reinforcing region extending from said central region to said depending annular skirt portion, said reinforcing region having a thickness greater than said central region, and overlying said annular seal bead of said sealing liner.

2. A composite closure in accordance with claim 1, wherein said annular seal bead has a generally convex cross-sectional configuration.

3. A composite closure in accordance with claim 1, wherein said annular shoulder of said skirt portion defines an annular recess positioned adjacent said top wall portion, said sealing portion of said liner extending into said annular recess.

4. A composite closure, comprising:

a plastic outer closure cap having a top wall portion, and an annular skirt portion depending from the top wall portion, said skirt portion including an internal thread formation, and an inwardly extending annular shoulder positioned at the juncture of said top wall portion of said skirt portion; and a compression molded sealing liner positioned within said closure cap adjacent the inside surface of said top wall portion, said liner including a sealing portion at the periphery thereof adjacent said annular shoulder of said skirt portion, said sealing portion including a generally inwardly facing sealing surface, said sealing liner further including an annular seal bead projecting downwardly away from said top wall portion, said seal bead having an inwardly tapering cross-sectional configuration, and presenting another sealing surface, said top wall portion including a relatively thick, peripheral reinforcing region overlying said annular seal bead of said sealing liner.

5. A composite closure in accordance with claim 4, wherein:

said reinforcing region has an inside diameter less than the inside diameter of said annular seal bead.

6. A composite closure in accordance with claim 5, wherein:

said annular seal bead has a generally convex cross-sectional configuration.

7. A method of sealing a container having pressurized contents during top-loading of the container, comprising the steps of:

providing a composite closure having a plastic outer closure cap including a top wall portion and an annular skirt portion depending from said top wall portion, and an inner sealing liner positioned adjacent said top wall portion including a generally inwardly facing sealing portion at the periphery thereof, and an annular seal bead projecting downwardly away from said top wall portion presenting a generally downwardly facing sealing surface, said seal bead having an inwardly tapering cross sectional configuration;

applying said composite closure to a container so that said sealing portion of said liner sealingly engages a generally outwardly facing surface of said container;

outwardly deforming said top wall portion of said closure cap under the influence of pressure within said container, while maintaining said sealing portion in sealing engagement with said container; and subjecting said closure to top-loading in opposition to outward deformation of said top wall portion to thereby deform said downwardly projecting annular seal bead and urge said annular seal bead into sealing engagement with a generally upwardly facing surface of said container before said sealing portion of said liner is moved in a direction out of sealing engagement with the outwardly facing surface of the container.

8. A method of sealing a container having pressurized contents during top-loading of the container, comprising the steps of:

providing a composite closure having a plastic outer closure cap including a top wall portion and an annular skirt portion depending from said top wall portion, and an inner sealing liner positioned adjacent said top wall portion including generally inwardly facing sealing portion at the periphery thereof, and an annular seal bead projecting downwardly away from said top wall portion presenting a generally downwardly facing sealing surface;

applying said composite closure to a container so that said sealing portion of said liner sealingly engages a generally outwardly facing surface of said container;

outwardly deforming said top wall portion of said closure cap under the influence of pressure within said container, while maintaining said sealing portion in sealing engagement with said container; and subjecting said closure to top-loading in opposition to outward deformation of said top wall portion to thereby urge said annular seal bead into sealing engagement with a generally upwardly facing surface of said container before said sealing portion of said liner is moved in a direction out of sealing engagement with the outwardly facing surface of the container, including reinforcing said top wall portion of said outer closure cap by providing said top wall portion with a relatively thick, annular reinforcing region overlying said annular seal bead of said sealing liner.

* * * * *